252-103 AU 157 EX
9/3/85 XR 4,539,007

United States Patent [19]
Rösch et al.

[11] Patent Number: 4,539,007
[45] Date of Patent: Sep. 3, 1985

[54] PROCESS FOR THE SIMULTANEOUS DESIZING AND BLEACHING OF TEXTILE MATERIAL MADE FROM CELLULOSE FIBERS

[75] Inventors: Günter Rösch, Bad Soden am Taunus; Gerhard Sauer, Kelkheim, both of Fed. Rep. of Germany

[73] Assignee: Hoechst Aktiengesellschaft, Frankfurt am Main, Fed. Rep. of Germany

[21] Appl. No.: 492,821

[22] Filed: May 9, 1983

[30] Foreign Application Priority Data

May 19, 1982 [DE] Fed. Rep. of Germany ..... 3218889

[51] Int. Cl.[3] ..... D06L 3/02; D06L 1/06; D06L 1/14; D06L 3/00

[52] U.S. Cl. ..... 8/111; 8/138; 252/103

[58] Field of Search ..... 8/111, 138

[56] References Cited

U.S. PATENT DOCUMENTS

| | | | |
|---|---|---|---|
| 3,682,583 | 8/1972 | Kravetz et al. | 8/111 |
| 3,756,774 | 9/1973 | Kirner | 8/111 |
| 3,829,291 | 8/1974 | Kravetz | 8/111 |
| 3,840,466 | 10/1974 | Gray | 252/99 |
| 4,116,878 | 9/1978 | Deutscher et al. | 252/94 |

FOREIGN PATENT DOCUMENTS

| | | | |
|---|---|---|---|
| 678942 | 11/1964 | Canada | 8/111 |
| 2038485 | 2/1970 | Fed. Rep. of Germany . | |
| 1502560 | 3/1978 | United Kingdom . | |

OTHER PUBLICATIONS

Chemical Abstracts 92:95589k, (3/1980).
Chemical Abstracts 95:44634a, (8/81).
Chemical Abstracts 80:4864j, (1/74).

*Primary Examiner*—Paul Lieberman
*Assistant Examiner*—John F. McNally
*Attorney, Agent, or Firm*—Connolly and Hutz

[57] ABSTRACT

A process for the simultaneous desizing and bleaching of textile material made from cellulose fibers, which comprises treating the textile material with a liquor containing per liter of water (a) from 1 to 10 grams of a peroxide activator,
(b) from 10 to 80 ml of hydrogen peroxide,
(c) from 1 to 10 grams of urea,
(d) from 1 to 10 grams of a surfactant and a compound of weakly alkaline reaction in such an amount that the pH of the liquor is 7 to 8.

4 Claims, No Drawings

PROCESS FOR THE SIMULTANEOUS DESIZING AND BLEACHING OF TEXTILE MATERIAL MADE FROM CELLULOSE FIBERS

Desizing and bleaching of fabrics containing cellulose fibers is carried out in general continuously in several process steps. First the starch (sizing) applied onto the fabric before weaving is removed, for example by means of enzymes (amylases). Generally, a treatment with alkalis follows, in which the fabric is impregnated with solutions containing surfactants and optionally complexing agents in addition to sodium hydroxide solution. Subsequently, the fabric is steamed for a time of up to 60 minutes. In the case where a suitable steamer is not at hand, the goods may be treated for several hours at room temperature. Thereafter, the alkali and the impurities of the cotton are removed by washing and rinsing with hot water.

The next step is bleaching with hydrogen peroxide. The fabric is impregnated with a bleaching liquor which in addition to hydrogen peroxide contains alkali in the form of sodium hydroxide solution, which is required for activating the hydrogen peroxide. In order to attain a good bleaching effect, the operations are carried out at a pH of above 10, preferably above 12. In order to prevent uncontrolled splitting-off of oxygen (by catalytic decomposition of the hydrogen peroxide), which would damage the fabric, addition of so-called stabilizers is required. The stabilizer used in most cases is water glass (sodium silicate) which due to its buffering effect sets free the oxygen in a controlled manner and furthermore prevents catalytic decomposition by incorporation of heavy metal ions into its molecule chain. The disadvantage resides in the fact that sodium silicate cannot be removed but with difficulty from the fabric and causes often an unpleasant, sandy feel thereof. Moreover, deposits of silicate residues on machine parts such as rollers, walls of apparatus etc. can be formed easily. Attempts have therefore been made to replace water glass by other, mostly organic, stabilizers, for example on the basis of salts of ethylenediamine-tetraacetic acid. However, these stabilizers generally lack the buffering action of the sodium silicate, so that the oxygen is set free in a less controlled manner and the bleaching effect is reduced. On the whole, the sequence of process steps as described ensures a high bleaching effect as well as a perfect desizing.

For reasons of rationalization, however, attempts have been made to condense this three-step process by renouncing, for example, the separate desizing. By bleaching with hydrogen peroxide a partial oxidative degradation of the starch is obtained, and this partial desizing is sufficient for certain goods, for example linen goods, which subsequently are merely finished. Further suitable oxidative desizing agents are peroxy-disulfates (such as ammonium, potassium, sodium persulfates). It is, however, impossible to add them to the bleaching liquors, because they cause too much damage to the fibers. They are therefore applied in the alkali step, thus attaining a desizing degree which allows dyeing of the fabrics so treated.

In oder to condense the process still further, it would be desirable to carry out the required desizing in the bleaching step and simultaneously to renounce a separate preliminary treatment with alkali.

A genuinely single-step process has now been found which allows a simultaneous desizing and bleaching in one liquor. This process comprises treating the textile material with a liquor containing per liter of water (a) from 1 to 10, preferably 1 to 3, grams of a peroxide activator,
(b) from 10 to 80, preferably 15 to 60, ml of hydrogen peroxide,
(c) from 1 to 10, preferably 3 to 6, grams of urea,
(d) from 1 to 10, preferably 3 to 6, grams of a surfactant, and a compound of weakly alkaline reaction in such an amount that the pH of the liquor is 7 to 8.

The process of the invention is carried out according to the methods usual in bleaching, for example in the form of hot or cold bleaching. In the first case, the fabric is impregnated with a liquor of the above composition, squeezed to a liquor uptake of about 60 to 120 weight %, and then heated with steam to a temperature of about 40° to 140°, preferably 80° to 105° C. The treatment time depends on the prevailing temperature and ranges from about 2 minutes to several hours. In the case of cold bleaching, the impregnated goods are allowed to dwell for about 8 to 24, preferably 12 to 18, hours at room temperature, the time depending on the desizing and bleaching degree. In both cases, the goods are finally washed and dried.

Alternatively, the fabric may be treated continuously in a long bath of the above composition, for example at a goods-to-liquor ratio of about 1:10. The temperature of the bath is about 50° to 95° C., preferably 60° to 85° C., and the time of treatment is about 10 to 40 minutes. In order to maintain a uniform concentration of the chemicals in the liquor, the incoming web is advantageously impregnated previously in the manner as described above.

The hydrogen peroxide required for the process of the invention is preferably used in form of the commercial aqueous 35% solution. The above limits of 10 and 80 ml, respectively, of hydrogen peroxide are calculated on this concentration. Suitable surfactants are all relevant products known to those skilled in the art, preferably commercial surfactants of the following groups: sec.-alkanesulfonates, alkylphenolsulfonates, nonylphenoloxethylates and fatty alcohol oxethylates. These surfactants serve for a better wetting of the goods by the liquor. Compounds having a weakly alkaline reaction are above all sodium bicarbonate and triethanolamine. These substances are added to the bleaching/desizing liquor in such an amount that a pH of 7 to 8 is adjusted in the liquor. This lower pH range as compared to that of a normal bleaching in a strongly alkaline bath allows to add usual enzymatic desizing agents to the liquor which are active in a pH range of 6.5 to 7.5 only. This facultative addition of enzymatic desizing agents is recommended especially in the case of hard-to-get-rid-off sizing agents. Alternatively, usual oxidative desizing agents may be added to the liquor, such as ammonium, potassium or sodium peroxydisulfate.

Peroxide activators are all compounds known to be suitable for this application, such as acylated hydroxylamines, acylamides or acylated heterocycilc compounds (see Text. Praxis Intern. 1974, p. 1392 et sequ.). Particularly preferred acyl compounds are tetraacylethylenediamine and tetraacetylglycolurile.

The process of the invention allows simultaneous desizing and bleaching in one bath, which means a considerable simplification as compared to the usual operation mode using the separate bleaching and desizing bath, respectively. On the other hand, there is still the possibility of pretreating the fabric in a separate alkali bath. Another considerable advantage of the novel process as described resides in operating in a weakly alkaline range, so that there is no risk of damaging the fiber by degradation as in the usual bleaching in a strongly alkaline range. Moreover, the hitherto usual stabilization of the bleaching bath can be renounced, thus avoiding the disadvantages inherent in the use of water glass, as described above.

The following examples illustrate the invention.

EXAMPLE 1

After singeing, a cotton batiste was impregnated with a liquor containing 30 ml/l hydrogen peroxide (35 weight%)
2 g/l sodium bicarbonate
3 g/l urea
5 g/l nonylphenoloxethylate with 10 EO
3 g/l tetraacetyl-ethylene diamine The liquor uptake was 70 weight %.

After impregnation, the fabric was heated to 100° C., and stored for 20 minutes at this temperature in a j-box. Subsequently, it was washed and rinsed, respectively, in a continuous washing machine: 2 times at 90° C., 2 times at 60° C. and 2 times in cold water. The data of the material were as follows:

| | | grey goods: |
|---|---|---|
| degree of whiteness | 85% | 61% |
| desizing degree according to "Tegewa" | 7 | 1 |
| average polymerisation degree (AP degree) | 2420 | 2780 |

EXAMPLE 2

A shirting of polyester/cotton 50:50 was impregnated with the following bleaching solution:

50 ml/l hydrogen peroxide (35 weight %)
2 ml/l triethanolamine
3 g/l urea
5 ml/l surfactant (90% alkane sulfonate 30% strength + 10% nonylphenolpolyglycol ether with 8 EO)
3 g/l tetraacetyl-ethylene diamine
1 g/l potassium persulfate The liquor uptake was 70%.

After impregnation the fabric was wound up on a batching roller, and allowed to dwell for 16 hours at room temperature. Subsequently, it was washed continuously in 2 units of a washing machine having 6 boxes with addition of 3 ml/l of 50% sodium hydroxide solution and 3 ml/l of the above surfactant mixture. In 2 further boxes, the fabric was rinsed at 60° C. and 2 times with cold water. The data of the fabric were as follows:

| | | grey goods: |
|---|---|---|
| degree of whiteness (R 46) | 87% | 67% |
| desizing degree | 9 | 1 |
| AP degree | 2530 | 2890 |

EXAMPLE 3

8,000 meters of cotton cord were treated as follows:

impregnation with treating liquor in a saturator (squeezing effect 75%)
dwelling in the liquor in a floated j-box,
washing at boiling temperature in a washing unit,
rinsing in 2 washing units at 60° and 25° C., respectively,
squeezing and drying.

The treating liquor in the saturator and the j-box had the following composition:

30 ml/l hydrogen peroxide (35 weight %)
3 g/l sodium bicarbonate
3 g/l urea
3 g/l surfactant (alkylbenzene sulfonate 70%)
3 g/l tetraacetyl-ethylene diamine The dwelling time in the j-box was 25 minutes, the temperature 85° C. After washing, rinsing and drying, the fabric had the following data:

| | | grey goods: |
|---|---|---|
| degree of whiteness | 84% | 58% |
| desizing degree | 7 | 1–2 |
| AP degree | 2320 | 2845 |

EXAMPLE 4

After singeing and without desizing, a grey cotton cloth was impregnated with a liquor containing 40 g/l of caustic soda and 5 g/l of surfactant (alkanesulfonate 60%). The liquor uptake was 85%. After impregnation, the fabric was heated with steam to 100° C., and maintained for 20 minutes at this temperature. Subsequently, it was washed continuously in a washing machine (2 times at 90° C., 2 times at 60° C., 2 times with cold water). After this treatment, the fabric had a desizing degree according to the TEGEWA scale of 1 (1=no desizing effect, 9=complete desizing). The alkali test was negative. The fabric was then impregnated without intermediate drying, using the following liquor:

60 ml/l hydrogen peroxide (35 weight %)
1 g/l triethanolamine
3 g/l urea
3 g/l tetraacetyl-glycolurile
3 g/l alkanesulfonate 60%.

The squeezing effect was 90%, the liquor exchange had been determined during the impregnation as being 85%.

After impregnation, the material was heated again with steam to 100° C., and maintained for 30 minutes at this temperature. Subsequently, it was washed and rinsed as indicated above. After the treatment, the goods showed the following data:

| | grey goods | alkali step | bleaching step desizing |
|---|---|---|---|
| degree of whiteness (R 46) | 56% | 61% | 87% |
| desizing degree "Tegewa" | 1 | 1 | 6 |
| average polymerisation degree (AP) | 2850 | 2410 | 2180 |

EXAMPLE 5

The same material was treated as indicated in Example 4 with the difference, however, of adding 2 g/l of bacteria amylase (15,000 Effront units) to the bleaching step. The desizing degree was thus raised to 9, while the other results remained unchanged.

What is claimed is:

1. A process for the simultaneous desizing and bleaching of textile material made from cellulose fibers, which comprises treating the textile material with a liquor containing per liter of water (a) from 1 to 10 grams of a peroxide activator,
(b) from 10 to 80 ml of hydrogen peroxide,
(c) from 1 to 10 grams of urea,
(d) from 1 to 10 grams of a surfactant and a compound of weakly alkaline reaction in such an amount that the pH of the liquor is 7 to 8.

2. The process as claimed in claim 1, which comprises treating the textile material with a liquor containing (a) from 1 to 3 g of tetraacetyl-ethylenediamine,
(b) from 15 to 60 ml of hydrogen peroxide,
(c) from 3 to 6 g of urea and
(d) from 3 to 6 g of surfactant.

3. The process as claimed in claim 1, which comprises treating the textile material with a liquor containing as surfactant a sec.-alkanesulfonate, alkylphenolsulfonate, nonylphenoloxethylate or fatty alcohol oxethylate, and as compound having a weakly alkaline reaction sodium bicarbonate or triethanolamine.

4. The process as claimed in claim 1, which comprises adding an enzymatic desizing agent to the liquor.

* * * * *